US011523637B2

(12) United States Patent
Han et al.

(10) Patent No.: US 11,523,637 B2
(45) Date of Patent: Dec. 13, 2022

(54) MAGNETIC DRIVE PUMPING APPARATUS FOR ELECTRONIC CIGARETTE LIQUIDS AND ELECTRONIC CIGARETTE PRODUCT INCLUDING THE MAGNETIC DRIVE PUMPING APPARATUS

(71) Applicant: CHINA TOBACCO YUNNAN INDUSTRIAL CO., LTD, Kunming (CN)

(72) Inventors: Yi Han, Kunming (CN); Shoubo Li, Kunming (CN); Tinghua Li, Kunming (CN); Donglai Zhu, Kunming (CN); Xia Zhang, Kunming (CN); Wei Zhao, Kunming (CN); Xiaowei Gong, Kunming (CN); Yongkuan Chen, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 347 days.

(21) Appl. No.: 16/766,705

(22) PCT Filed: Aug. 8, 2019

(86) PCT No.: PCT/CN2019/099831
§ 371 (c)(1),
(2) Date: May 25, 2020

(87) PCT Pub. No.: WO2020/191986
PCT Pub. Date: Oct. 1, 2020

(65) Prior Publication Data

US 2021/0195956 A1 Jul. 1, 2021

(30) Foreign Application Priority Data

Mar. 25, 2019 (CN) ..... 201910228759.8

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01); *A24F 40/48* (2020.01);
(Continued)

(58) Field of Classification Search
CPC ..... A24F 40/48; A24F 40/485; A24F 40/10; A24F 40/42; F04B 43/043
See application file for complete search history.

(56) References Cited

U.S. PATENT DOCUMENTS

2018/0343925 A1* 12/2018 Wensley ..... F04B 19/00

FOREIGN PATENT DOCUMENTS

CN 106579566 A 4/2017
CN 206413749 U 8/2017
(Continued)

*Primary Examiner* — Jean F Duverne
(74) *Attorney, Agent, or Firm* — Bayramoglu Law Offices LLC

(57) ABSTRACT

A magnetic drive pumping apparatus for electronic cigarette liquids and an electronic cigarette product including the magnetic drive pumping apparatus are provided. The magnetic drive pumping apparatus includes a magnetic drive micro-pump including a housing body and a pump body. A pump diaphragm is arranged inside the housing body, and a pump chamber is formed between the housing body and the pump diaphragm. A valve seat and a valve diaphragm are in the pump body. The pump diaphragm, the valve seat and the valve diaphragm jointly define a flow channel of electronic cigarette liquids. The pump diaphragm is fixed with a permanent magnet, and an inner wall of the housing body is fixed with an electromagnet corresponding to the permanent
(Continued)

magnet. A liquid storage element includes a liquid tank and an air vent. The inlet of electronic cigarette liquids is connected to the liquid tank for liquids to pass through.

10 Claims, 2 Drawing Sheets

(51) Int. Cl.

| | |
|---|---|
| ***A24F 40/42*** | (2020.01) |
| ***F04B 23/02*** | (2006.01) |
| ***F04B 43/00*** | (2006.01) |
| ***F04B 43/04*** | (2006.01) |
| ***A24F 40/48*** | (2020.01) |

(52) U.S. Cl.
CPC ..... *F04B 23/02* (2013.01); *F04B 43/0009* (2013.01); *F04B 43/043* (2013.01)

(56) References Cited

FOREIGN PATENT DOCUMENTS

| | | | |
|---|---|---|---|
| CN | 108095197 | A | 6/2018 |
| CN | 208510077 | U | 2/2019 |
| CN | 109770437 | A | 5/2019 |

* cited by examiner

MAGNETIC DRIVE PUMPING APPARATUS FOR ELECTRONIC CIGARETTE LIQUIDS AND ELECTRONIC CIGARETTE PRODUCT INCLUDING THE MAGNETIC DRIVE PUMPING APPARATUS

CROSS REFERENCE TO THE RELATED APPLICATIONS

This application is the national phase entry of International Application No. PCT/CN2019/099831, filed on Aug. 8, 2019, which is based upon and claims priority to Chinese Patent Application No. 201910228759.8, filed on Mar. 25, 2019, the entire contents of which are incorporated herein by reference.

TECHNICAL FIELD

The present invention belongs to the technical field of electronic cigarettes, and more specifically, relates to a magnetic drive pumping apparatus for electronic cigarette liquids and an electronic cigarette product including the magnetic drive pumping apparatus.

BACKGROUND

Liquids of electronic cigarettes are typically delivered to a heating element by way of siphoning a wicking component, e.g., wicking cotton, or a liquid tank. When transmitted in this manner, the volume of liquid delivered to the heating element is unable to be controlled. Whether excessive or insufficient, if the incorrect volume of cigarette liquid is delivered, certain heating inefficiencies of the heating element are realized. An insufficient amount of electronic cigarette liquid delivered may lead to a dry burning or a ruined heater as a result of the element's elevated operating temperatures, in which case malodorous smoke and steam may be produced. On the other hand, an excessive amount of electronic cigarette liquid delivered may result in insufficient atomization of the liquid as a result of the heating element operating below its ideal temperature, in which case the amount of smoke may be significantly reduced and the user made to feel as if s/he is inhaling the cigarette liquid.

In order to manage the transmission of cigarette liquid and solve the above problems, manufacturers have employed micro-pumps through which directional quantitative pumping of electronic cigarette liquid may be achieved. Some of the subject pumps and devices have been patented. In prior patent documents, however, the liquid tank and the micro-pump are generally disclosed as being separated resulting in an electronic cigarette of relatively large overall size. Moreover, the micro-pump components of such devices must be connected to the liquid tank and the heating element through various conduits and sealing apparatus, which presents numerous inefficiencies and too many parts. This makes the product not well-integrated, difficult and expensive to manufacture and assemble and increases the risk that the electronic cigarette liquid may leak.

Magnetic drive micro-pumps are driven by external magnetic fields and are capable of pumping a large volume of liquids safely and reliably under low voltage with rapid response time.

SUMMARY

The present invention provides a magnetic drive pumping apparatus for electronic cigarette liquids and an electronic cigarette product including the magnetic drive pumping apparatus. The apparatus has the advantages of low input voltage, highly flexible pump diaphragm, ease of frequency adjustment, and quick response, which can lower the power consumption and accelerate the delivery of electronic cigarette liquids when pumping.

The present invention is implemented by the following technical solutions.

In one aspect of the invention, a magnetic drive pumping apparatus for electronic cigarette liquids, which includes the following components:

the magnetic drive micro-pump 101; wherein the magnetic drive micro-pump 101 includes the housing body 5 and the pump body 6. The pump diaphragm 10 is arranged inside the housing body 5, and the pump chamber 7 is formed between the housing body 5 and the pump diaphragm 10. The valve seat 1 and the valve diaphragm 2 are set in the pump body 6. The pump diaphragm 10, the valve seat 1 and the valve diaphragm 2 jointly define the flow channel 4 of electronic cigarette liquids. One end of the flow channel is the inlet 9 of electronic cigarette liquids, and the other end of the flow channel is the outlet 8 of electronic cigarette liquids. The pump diaphragm 10 is fixed with the permanent magnet 11, and the inner wall of the housing body 5 is fixed with the electromagnet 12 corresponding to the permanent magnet 11; and the liquid storage element 102; wherein the liquid storage element 102 includes the liquid tank 3 and the air vent 14; and the inlet 9 of electronic cigarette liquids is connected to the liquid tank 3 for liquids to pass through.

In a preferred implementation of the present invention, the outlet 8 of electronic cigarette liquids is connected to an atomizer.

In a preferred implementation of the present invention, the outer wall of housing body 5 is fixed with annular electrodes or the housing body 5 is fixed with pin-shaped or chip-shaped contact electrode, so that the magnetic drive micro-pump is connected to a power supply and a control system.

In a preferred implementation of the present invention, the outer wall of the housing body 5 is equipped with a wiring duct, wires are contained in the wiring duct, and the wires are configured to connect the magnetic drive micro-pump 101 to the annular electrode.

In a preferred implementation of the present invention, the flow channel 4 of electronic cigarette liquids is a non-linear flow channel.

In the present invention, the flow channel 4 of electronic cigarette liquids is designed in a form of broken line or spiral line to extend the flow path of liquids increase the pumping pressure on liquids in the case of the magnetic drive micro-pump 101 having a small size.

In the present invention, the magnetic drive micro-pump 101 and the pump chamber 7 are small enough to concentrate the driving energy, facilitating the rapid and powerful pumping of the liquids.

In the present invention, the magnetic drive micro-pump 101 is integrated with the liquid storage element 102 to form one piece. The various pipelines through which the magnetic drive micro-pump 101 is connected to the liquid storage element and the heating element can be eliminated by providing the wiring duct on the pump body for accommodating wires, greatly enhancing the integration of the magnetic drive micro-pump 101, the liquid storage element 102 and the heating element, significantly minimizing the apparatus and increasing the portability.

In a preferred implementation of the present invention, the valve diaphragm 2 can be produced by spin coating the room temperature vulcanized silicone rubber on the stainless steel substrate. The pump diaphragm 10 can be produced by a solvent casting method, namely, pouring the room temperature vulcanized silicone rubber on the polypropylene substrate. Alternatively, the pump diaphragm 10 can also be made of other highly elastic polymer materials (such as SU-8, PMMA, etc.). The permanent magnet 11 is placed in the center of the pump diaphragm 10. The electromagnet 12 is embedded in the inner wall of the housing body 5 and directly opposite to the permanent magnet 11. To ensure vibration of the pump diaphragm, a predetermined distance should be maintained between the electromagnet 12 and the permanent magnet 11. The wire duct can be provided on or inside the micro-pump housing body to contain the wires connected to the electromagnet 12.

In a preferred implementation of the present invention, the permanent magnet 11 can be a Nd—Fe—B block or a Sm—Co magnet, which is combined with the pump diaphragm 10 by bonding. Alternatively, magnetic materials can be integrated on the pump diaphragm 10 by micro-manufacturing techniques such as electroplating, sputtering, pulsed laser deposition and others. The electromagnet 12 can be a conventional ring-core structure, a curved ring-core structure, or a multi-layer patterned chip-shaped structure.

In a preferred implementation of the present invention, each of the micro components can be manufactured using Micro-Electro-Mechanical System (MEMS) technology, and the assembly of the components can be achieved by lamination, adhesion, bonding, and other known securing methods. The air vent 14 is provided at the bottom of the housing of the liquid storage element 102 and configured for balancing the pressures inside and outside the apparatus during inhalation. In addition, the air vent 14 allows the liquid tank 3 to shrink and expand to facilitate the flow of electronic cigarette liquids to the micro-pump.

The second aspect of the present invention relates to an electronic cigarette product including the magnetic drive pumping apparatus for electronic cigarette liquids, including any one of the above magnetic drive pumping apparatus for electronic cigarette liquids.

The working principle of the present invention is as follow. The electromagnet 12 produces an external magnetic field when being applied with a voltage. The permanent magnet 11 is attracted and repelled accordingly to induce the vibration of the pump diaphragm 10, which ultimately drives the opening and closing of the valve diaphragm 2. By periodical opening and closing of the valve diaphragm 2, the electronic cigarette liquids 13 in the liquid tank 3 is driven to enter the magnetic drive micro-pump 101 (when pumping into) and be discharged from magnetic drive micro-pump 101 (when pumping out). FIG. 2 and FIG. 3 show the effects of pumping-in and pumping-out of the electronic cigarette liquids, respectively.

Advantages

1. In the present invention, the flow channel of electronic cigarette liquids is designed in a form of broken line or spiral line to extend the flow path of the electronic cigarette liquids and increase the pumping pressure on the electronic cigarette liquids in the case of the magnetic drive micro-pump having a small size.

2. In the present invention, the magnetic drive micro-pump is integrated with the liquid storage element to form one piece. The various conduits through which the magnetic drive micro-pump is connected to the liquid storage element and the heating element can be eliminated by providing the wiring duct on the pump body for accommodating wires, significantly enhancing the integration of the magnetic drive micro-pump, the liquid storage element and the heating element, substantially minimizing the apparatus and increasing the portability.

3. The magnetic drive micro-pump has the advantages of low input voltage, highly flexible pump diaphragm, the ease of frequency adjustment, and quick response, which can lower the power consumption and accelerate the delivery of electronic cigarette liquids when pumping.

4. The flow channel of electronic cigarette liquids is enclosed inside the micro-pump, avoiding the flow blockage caused by bubbles in the pipelines arranged outside the micro-pump and the possible leakage of electronic cigarette liquids due to poor sealing between the pipelines and the micro-pump.

5. The built-in liquid tank is conducive to the miniaturization and portability of electronic cigarettes because separate external liquid tank components can be eliminated. Furthermore, the electronic cigarette liquids stored in the built-in liquid tank are stable and clean because they are totally isolated from the external environment.

Figure 1:
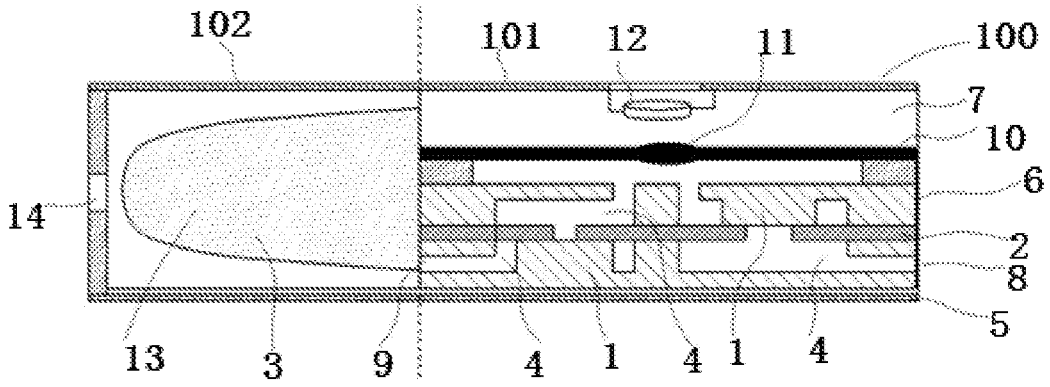
FIG. 1 shows a cross-sectional view of the magnetic drive pumping apparatus for electronic cigarette liquids.
Figure 2:
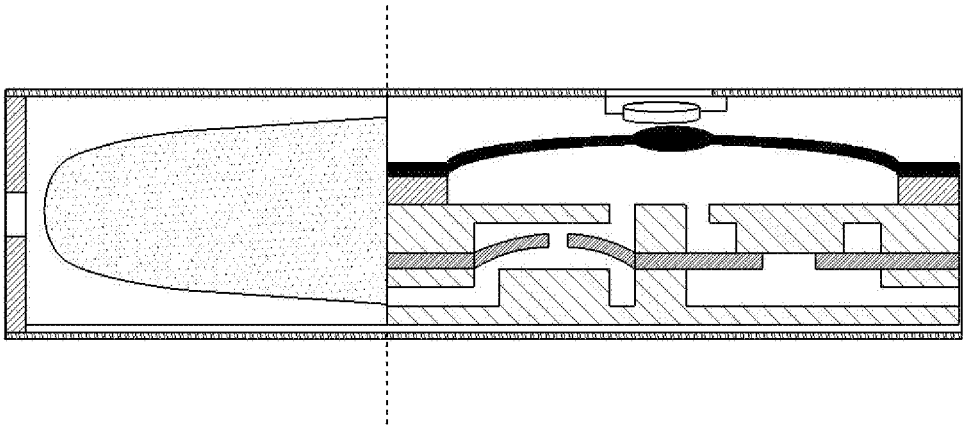
FIG. 2 is a schematic diagram showing the structure of the magnetic drive pumping apparatus for electronic cigarette liquids when the electronic cigarette liquids are pumped into the magnetic drive pumping apparatus.
Figure 3:
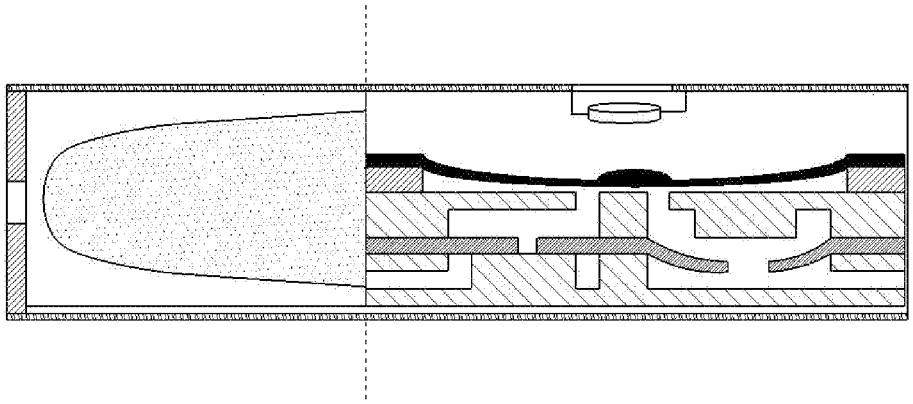
FIG. 3 is a schematic diagram showing the structure of the magnetic drive pumping apparatus for electronic cigarette liquids when the electronic cigarette liquids are pumped out of the magnetic drive pumping apparatus.

100—magnetic drive pumping apparatus, 101—magnetic drive micro-pump, 102—liquid storage element; 1—valve seat, 2—valve diaphragm, 3—liquid tank, 4—flow channel of electronic cigarette liquids, 5—housing body, 6—pump body, 7—pump chamber, 8—outlet of electronic cigarette liquids, 9—inlet of electronic cigarette liquids, 10—pump diaphragm, 11—permanent magnet, 12—electromagnet, 13—electronic cigarette liquids, 14—air vent.

DETAILED DESCRIPTION OF THE EMBODIMENTS

Embodiment

A magnetic drive pumping apparatus for electronic cigarette liquids includes the following components:

the magnetic drive micro-pump 101; wherein the magnetic drive micro-pump 101 includes the housing body 5 and the pump body 6, and the pump diaphragm 10 is arranged inside the housing body 5, and the pump chamber 7 is formed between the housing body 5 and the pump diaphragm 10. The valve seat 1 and the valve diaphragm 2 are set in the pump body 6. The pump diaphragm 10, the valve seat 1 and the valve diaphragm 2 jointly define the flow channel 4 of electronic cigarette liquids. One end of the flow channel is the inlet 9 of electronic cigarette liquids, and the other end of the flow channel is the outlet 8 of electronic cigarette liquids, The pump diaphragm 10 is fixed with the permanent magnet 11, and the inner wall of the housing body 5 is fixed with the electromagnet 12 corresponding to the permanent magnet 11.

The liquid storage element 102 includes the liquid tank 3 and the air vent 14. The inlet 9 of electronic cigarette liquids is connected to the liquid tank 3 for liquids to pass through.

In the present embodiment, the outlet 8 of electronic cigarette liquids is connected to an atomizer.

In the present embodiment, the outer wall of the housing body 5 is fixed with annular electrodes or the housing body 5 is fixed with pin-shaped or chip-shaped contact electrodes, so that the magnetic drive micro-pump is connected to a power supply and a control system.

In the present embodiment, the outer wall of the housing body 5 is provided with a wiring duct, wires are contained in the wiring duct, and the wires are configured for connecting the magnetic drive micro-pump 101 to the annular electrode.

In the present embodiment, the flow channel 4 of electronic cigarette liquids is a non-linear flow channel.

What is claimed is:

1. A magnetic drive pumping apparatus for electronic cigarette liquids, comprising:

a magnetic drive micro-pump, wherein the magnetic drive micro-pump comprises a housing body and a pump body, a pump diaphragm is arranged inside the housing body, and a pump chamber is formed between the housing body and the pump diaphragm; a valve seat and a valve diaphragm are set in the pump body, the pump diaphragm, the valve seat and the valve diaphragm jointly define a flow channel of electronic cigarette liquids; a first end of the flow channel of electronic cigarette liquids is an inlet of electronic cigarette liquids, and a second end of the flow channel of electronic cigarette liquids is an outlet of electronic cigarette liquids; the pump diaphragm is fixed with a permanent magnet, an inner wall of the housing body is fixed with an electromagnet, and the electromagnet corresponds to the permanent magnet; and a liquid storage element; wherein the liquid storage element comprises a liquid tank and an air vent; and the inlet of electronic cigarette liquids is connected to the liquid tank for the electronic cigarette liquids to pass through.

2. The magnetic drive pumping apparatus for the electronic cigarette liquids according to claim 1, wherein the outlet of electronic cigarette liquids is connected to an atomizer.

3. The magnetic drive pumping apparatus for the electronic cigarette liquids according to claim 1, wherein an outer wall of the housing body is fixed with a plurality of annular electrodes or the housing body is fixed with a plurality of pine-shaped or chip-shaped contact electrodes, so that the magnetic drive micro-pump is connected to a power supply and a control system.

4. The magnetic drive pumping apparatus for the electronic cigarette liquids according to claim 3, wherein the outer wall of the housing body is provided with a wiring duct, and a plurality of wires are contained in the wiring duct, and the plurality of wires are configured to connect the magnetic drive micro-pump to the plurality of annular electrodes.

5. The magnetic drive pumping apparatus for the electronic cigarette liquids according to claim 1, wherein the flow channel of electronic cigarette liquids is non-linear.

6. An electronic cigarette product, comprising the magnetic drive pumping apparatus for the electronic cigarette liquids according to claim 1.

7. The electronic cigarette product according to claim 6, wherein the outlet of electronic cigarette liquids is connected to an atomizer.

8. The electronic cigarette product according to claim 6, wherein an outer wall of the housing body is fixed with a plurality of annular electrodes or the housing body is fixed with a plurality of pine-shaped or chip-shaped contact electrodes, so that the magnetic drive micro-pump is connected to a power supply and a control system.

9. The electronic cigarette product according to claim 8, wherein the outer wall of the housing body is provided with a wiring duct, and a plurality of wires are contained in the wiring duct, and the plurality of wires are configured to connect the magnetic drive micro-pump to the plurality of annular electrodes.

10. The electronic cigarette product according to claim 6, wherein the flow channel of electronic cigarette liquids is non-linear.

* * * * *